United States Patent [19]

Goldsmith et al.

[11] Patent Number: 4,858,248

[45] Date of Patent: Aug. 22, 1989

[54] COMBINED HAT AND EARPHONES DEVICE

[76] Inventors: Steven E. Goldsmith, 1344 Taft Rd., Teaneck, N.J. 07666; Joseph M. Santi, 217 E. 33rd St., New York, N.Y. 10016

[21] Appl. No.: 152,758

[22] Filed: Feb. 5, 1988

[51] Int. Cl.[4] ..... A42B 1/04; A42B 1/20; A42B 1/24

[52] U.S. Cl. ..... 2/209.1; 2/185 R; 2/199; 2/201; 2/202; 455/351

[58] Field of Search ..... 2/209.1, 201, 202, 209, 2/199, 422, 185 R, 423, 6; 455/351, 100; 379/430

[56] References Cited

U.S. PATENT DOCUMENTS

| | | | |
|---|---|---|---|
| 2,998,611 | 9/1961 | Schuessler | 2/202 |
| 4,109,105 | 8/1978 | Von Statten, Jr. | 2/422 X |
| 4,130,803 | 12/1978 | Thompson | 325/361 |
| 4,525,878 | 7/1985 | Lowe, Jr. | 2/185 R |
| 4,641,647 | 2/1987 | Behan | 2/201 X |
| 4,654,898 | 4/1987 | Ishikawa | 2/209 |
| 4,669,129 | 6/1987 | Chance | 2/209 |
| 4,727,599 | 2/1988 | Rappaport et al. | 455/351 |
| 4,776,044 | 10/1988 | Makins | 2/199 |

FOREIGN PATENT DOCUMENTS

| | | | |
|---|---|---|---|
| 0593942 | 5/1959 | Italy | 2/423 |
| 1056998 | 11/1983 | U.S.S.R. | 2/209 |
| 0442606 | 2/1936 | United Kingdom | 2/6 |
| 1179946 | 2/1970 | United Kingdom | 2/199 X |

*Primary Examiner*—Peter Nerbun

*Attorney, Agent, or Firm*—Irving M. Weiner; Joseph P. Carrier; Pamela S. Burt

[57] ABSTRACT

A combined hat and earphones device comprises a flexible hat positionable over the head and ears of a person, and a pair of earphones integrally and inconspicuously connected to lower portions of the hat such that the earphones would be held adjacent the person's ears when the hat is being worn. The hat has an eyelet defined in an inner surface thereof, while electrical wires extending from the earphones extend downwardly out of the hat through the eyelet and have terminal ends thereof connected to a common plug member adapted to be received in the earphones jack of a portable radio or cassette player.

7 Claims, 1 Drawing Sheet

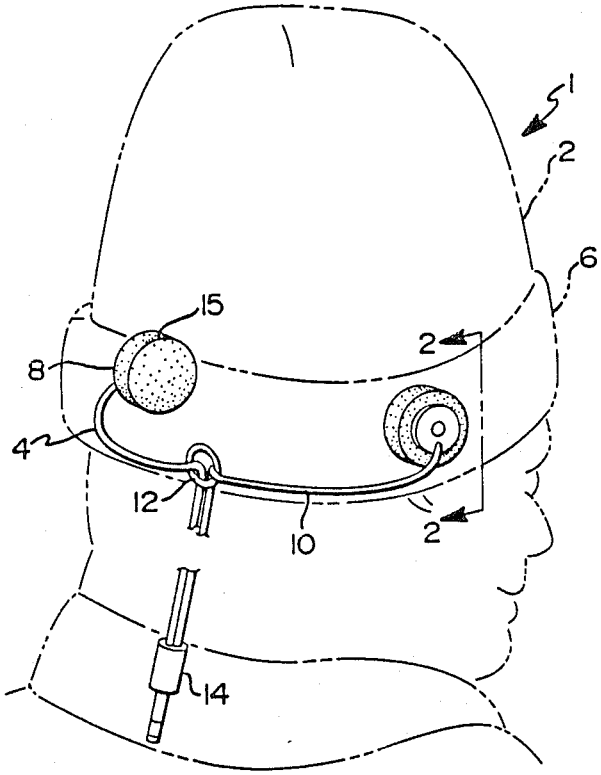
FIG 1
FIG 2
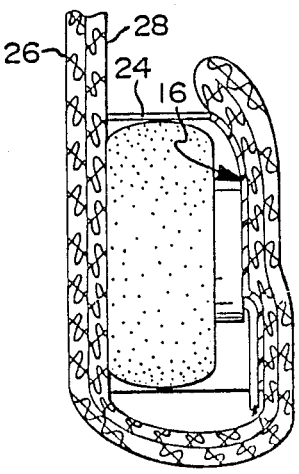
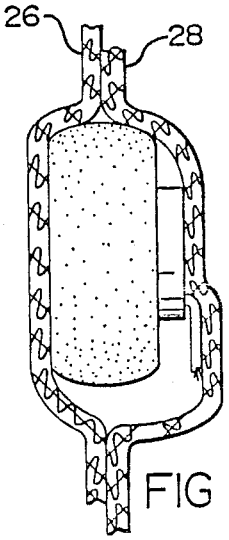
FIG 4
FIG 3
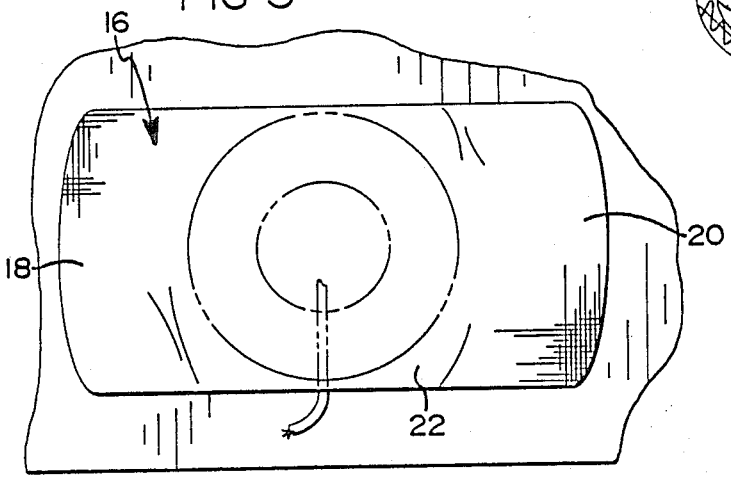

COMBINED HAT AND EARPHONES DEVICE

BACKGROUND OF THE INVENTION

1. Field of the Invention

The present invention pertains to a combined hat and earphones device wherein a conventional, flexible hat has integrally attached thereto a pair of earphones for a portable radio or cassette player. More particularly, the present invention pertains to such a combined device wherein a conventional, flexible hat, such as a knitted ski cap, has a set of earphones integrally and unnoticeably combined therewith.

2. Description of the Relevant Art

There are known devices which combine head or ear protecting members with earphones. For example, U.S. Pat. No. 4,130,803 discloses a rigid football or motorcycle helmet having earphones embedded in the inner cushioning pad of the helmet, while U.S. Pat. Nos. 4,654,898 and 4,669,129 disclose earmuff attachment members adapted to be fastened over the earphones of a conventional headphone set including a headband.

In one embodiment (FIG. 5) of the combined helmet-/earphone device disclosed in U.S. Pat. No. 4,130,803 the earphones are embedded in the inner cushioning pad of the helmet, while wires leading from the headphones terminate together in an electrical connection plug fixed to a rear lower portion of the helmet shell. In use, the headphones would be connected to a radio located externally, such as on a motorcycle, through a wired jack which plugs into/onto the connecting plug. One drawback of this combined device is that its specific construction is limited to helmet-type devices having a hard outer shell and an inner padding layer. Another drawback is that the electrical connecting plug must be conspicuously located on an outer surface of the helmet so that the wire jack can be properly connected thereto without causing discomfort to a person wearing the helmet.

On the other hand, the headset devices disclosed in U.S. Pat. Nos. 4,654,898 and 4,669,129 only provide cold-weather protection for a person's ears, and are otherwise very conspicuous because the headband and wires of the headset are not covered by the removable earmuff covers.

Thus, there remains in the art a need for a device which comfortably and inconspicuously combines earphones with conventional, flexible hat.

SUMMARY OF THE INVENTION

The present invention has been developed to overcome the above-discussed limitations and disadvantages of existing devices in the art.

According to the present invention, there is provided a combined hat and earphones device comprising a flexible hat positionable over the head and ears of a person, and a pair of earphones integrally connected to lower portions of the hat such that the earphones will be positioned adjacent the person's ears when the hat is being worn. The hat has an eyelet defined through an inner surface thereof, while each of the earphones has an electrical wire extending therefrom. Both of the wires extend downwardly out of the hat through the eyelet, while terminal ends of the wires are connected to a common plug member adapted to be received in or on an earphones jack of a portable radio or cassette player.

It is an object of the present invention to provide a conventional, flexible hat which has a pair of earphones integrally and inconspicuously combined therewith.

It is another object of the present invention to provide such a combined hat and earphones device which includes a connector plug for being directly connected to a portable radio or tape player.

It is yet another object of the present invention to provide such a combined hat and earphones device which can be comfortably worn on a person's head.

It is a further object of the present invention to provide a method for integrally and inconspicuously combining a pair of earphones with a conventional, flexible-type hat.

Other objects, advantages and salient features of the present invention will become apparent from the following detailed description, which, when taken into conjunction with the annexed drawings, discloses a preferred embodiment of the present invention.

BRIEF DESCRIPTION OF THE DRAWINGS

FIG. 1 is a perspective view of a combined hat and earphones device according to the present invention, the device being worn on a person's head. FIG. 1 does not depict a retaining means for connecting the earphones to the hat, while only the earphones are shown in solid lines so as to emphasize the location of the earphones adjacent the person's ears.

FIG. 2 is a cross-sectional view of the combined hat and earphones device shown in the direction of arrows 2-2 in FIG. 1.

FIG. 3 is a side view of a small portion of the combined device, the view showing a lower (uncuffed) end portion of the hat, one earphone and a retaining means for the earphone.

FIG. 4 is a cross-sectional view showing an alternative method of attaching the earphones within the hat.

DETAILED DESCRIPTION OF THE PREFERRED EMBODIMENTS

Referring to FIG. 1, there is shown a combined hat and earphones device according to the present invention, which is generally indicated by numeral 1. The combined device includes a hat 2 and a pair of earphones 4 integrally and inconspicuously connected thereto.

The hat 2 can be of any conventional, flexible variety which includes an upper portion for covering a person's head and a lower portion for covering the person's ears. Exemplary of such conventional hats is the ski hat shown in FIG. 1. Such ski hats are usually constructed of a knitted material and have a substantially tubular shape with the upper end closed by stitching and the lower end capable of being folded over to define a cuff 6.

The earphones 4 include a pair of speakers 8 which are connected to lower side portions of the hat such that they will be located adjacent the person's ears when the hat is worn in a normal fashion. Electrical wires 10 extend from the speakers 8 and downwardly out of the hat through an eyelet or opening 12 defined through another lower portion of the hat. The wires 10 extending out through the eyelet 12 are joined together along their lengths to define a single wire which terminates in a plug member 14 adapted to be directly received in the earphones jack of a portable radio or a cassette player. Such radio or cassette player could be held in the person's hand, shirt pocket or the like. The speakers 8 may optionally have padded covers 15 fitted thereover for added comfort and protection of the speakers, but in many instances such covers would be unnecessary.

The eyelet 12 is preferrably located intermediate the speakers 8, or at the back of the hat, so that the wires 10 extending downwardly therefrom will not distract the person and will not otherwise hinder of limit the person's movements. Also, the eyelet 12 is preferrably located a few inches upwardly from the lower edge of the hat so that when the lower end of the hat is folded upwardly to define the cuff 6, the cuff will cover the eyelet from external view.

Referring to FIGS. 2–3, there is shown a preferred construction for connecting the earphones 4 to the hat 2. In the depicted construction, a pair of retainers 16 are attached to lower portions of the hat 2, with one speaker 8 being enclosed between a corresponding one of the retainers 16 and the hat. Each retainer 16 may comprise a patch of fabric or sheet material which is attached to the hat by any appropriate means, including stitching, adhesive, Velcro brand fasteners, etc. Velcro brand fasteners would permit the retainers to be removably attached to the hat as desired, whereas stitching and adhesive would permanently attach the retainers 16 to the hat 2. If a permanent attachment means is used, each of the retainers 16 will preferably be attached to the hat 2 only at opposite ends 18, 20 thereof, so as to define a pocket 22 for the speakers 8. The pockets 22 will include upper openings 24, which permit the speakers 8 to be removably inserted into the pockets 22.

If desired, the retainers 16 can be omitted and the speakers 8 can be directly attached to portions of the hat 2 using appropriate attachment means such as stitching, rivots, strips of Velcro brand fastening material, etc. However, it is preferable to use the retainers 16 because they help to direct the sound output of the speakers to the person's ears. Also, the retainers 16 can be constructed from a waterproof material to provide added protection for the speakers 8.

In use, the combined hat and earphones devices would be placed over the person's head and ears in a normal fashion, and would be appropriately adjusted so that the speakers 8 are located adjacent the person's ears and the eyelet 12 is positioned at the back of the person's head. When the hat is thus situated, the earphone wires 10 would extend inwardly through the eyelet 12 towards and down the person's neck, and the earphones 4 are generally quite inconspicuous. In fact, if the person is wearing a coat with a high collar or a scarf, the earphones 4 can be completely concealed.

As an alternative to the disclosed embodiment, the speakers 8 may be simply connected to the hat 2 by being fixed between layers 26, 28 of material forming the hat. In such an alternative embodiment, the speakers would need to be appropriately located so that they would be positioned adjacent the person's ears when the hat is being worn, while the eyelet 12 would be formed only through the inner layer 26 of material.

Although there have been described what are at present considered to be the preferred embodiments of the present invention, it will be understood that the invention can be embodied in other specific forms without departing from the spirit or essential characteristics thereof. For example, the invention is not limited to devices including knitted ski-type hats. Rather, any conventional, flexible hat could be used. For example, the present invention could comprise a flexible cap with fold-down ear flaps and with the speakers 8 concealed within the ear flaps. The described embodiments are, therefore, to be considered in all aspects as illustrative, and not restrictive. The scope of the invention is indicated by the appended claims rather than the foregoing description.

We claim:

1. A combined hat and earphones device, comprising: a flexible hat positionable over the head and ears of a person; and a pair of earphones integrally and integrally and inconspicuously connected to lower portions of the hat such that the earphones will be held adjacent to the person's ears when the hat is being worn;

said hat having an eyelet defined in a lower surface thereof;

each of said earphones having an electrical wire extending therefrom, said wires extending downwardly out of said hat through the eyelet; and terminal ends of said wires being connected to a common plug member adapted to be received in a mating jack of a portable radio;

said hat comprises a knitted member having a substantially tubular shape with a lower end of the tube folded over to define a cuff and an upper end closed by stitching; and said earphones being held in position within opposing sides of portions of the cuff by a retaining means so that the earphones are substantially hidden from view.

2. A combined hat and earphones device according to claim 1, wherein:

said retaining means comprises an attachment means selected from the group consisting of adhesive, stitching, rivets, and Velcro brand fastening material.

3. A combined hat and earphones device according to claim 1, wherein:

said retaining means comprises patches of material which are attached to lower portions of the hat such that the earphones are enclosed between the patches and the lower portions of the hat.

4. A combined hat and earphones device according to claim 1, wherein:

said patches of material are attached to the lower portions of the hat so as to define accessible pockets therebetween, said earphones being removably insertable into said pockets.

5. A combined hat and earphones device according to claim 4, wherein:

said patches of materials are water resistant.

6. A combined hat and earphones device, comprising:

a flexible hat positionable over the head and ears of a person; and a pair of earphones integrally and inconspicuously connected to lower portions of the hat such that the earphones will be held adjacent to the person's ears when the hat is being worn, said hat comprises a knitted member having a substantially tubular shape with a lower end of the tube folded over to define a cuff and an upper end closed by stitching; and said earphones being held in position within opposing sides of portions of the cuff by a retaining means so that the earphones are substantially hidden from view.

7. A combined hat and earphones device comprising: a flexible hat positionable over the head and ears of a person; and a pair of earphones integrally and inconspicuously connected to lower portions of the hat such that the earphones will be held adjacent to the person's ears when the hat is being worn;

said hat having an eyelet defined in a lower surface thereof;

each of said earphones having an electrical wire extending therefrom, said wires extending downwardly out of said hat through the eyelet; and terminal ends of said wires being connected to a common plug member adapted to be received in a mating jack of a portable radio;

said hat comprises a knitted member having a substantially tubular shape with a lower end of the tube folded over to define a cuff and an upper end closed by stitching; and wherein said hat includes a plurality of layers of flexible material; and said earphones are secured between the layers of flexible material so that the earphones are substantially hidden from view.

* * * * *